US005687594A

United States Patent [19]

Wang

[11] Patent Number: 5,687,594

[45] Date of Patent: Nov. 18, 1997

[54] LOCK AND KEY COMBINATION WITH CHANGEABLE COMBINATION OF LOCKING PIECES

[76] Inventor: Teng-Kuo Wang, P.O. Box 96-405, Taipei 10098, Taiwan

[21] Appl. No.: 588,505

[22] Filed: Jan. 18, 1996

[51] Int. Cl.[6] ..... E05B 27/00

[52] U.S. Cl. ..... 70/495; 70/377; 70/358; 70/407

[58] Field of Search ..... 70/356–358, 365, 70/366, 375–377, 381, 382, 387, 490, 492, 495, 419–421, 496, 409, 405–407

[56] References Cited

U.S. PATENT DOCUMENTS

| | | | |
|---|---|---|---|
| 2,004,433 | 6/1935 | Fitzgerald | 70/419 |
| 2,070,233 | 2/1937 | Liss | 70/495 |
| 2,212,262 | 8/1940 | Busche | 70/375 X |
| 3,208,248 | 9/1965 | Tornoe | 70/377 X |
| 3,475,933 | 11/1969 | Kobrehel | 70/495 |
| 3,877,267 | 4/1975 | Harris, Jr. | 70/495 X |
| 3,990,282 | 11/1976 | Sorum | 70/495 |
| 4,015,458 | 4/1977 | Mercurio | 70/495 |
| 4,073,171 | 2/1978 | Moorhouse | 70/375 X |
| 4,404,824 | 9/1983 | Hennessy | 70/495 |
| 4,446,709 | 5/1984 | Steinbach | 70/496 |
| 4,512,166 | 4/1985 | Dunphy et al. | 70/377 X |
| 4,524,593 | 6/1985 | Hennessy | 70/358 |
| 4,966,021 | 10/1990 | Boag | 70/377 X |
| 5,052,205 | 10/1991 | Poli | 70/495 X |
| 5,131,249 | 7/1992 | Baden et al. | 70/407 X |
| 5,168,734 | 12/1992 | Duval et al. | 70/358 X |
| 5,349,830 | 9/1994 | Keller | 70/406 X |
| 5,438,857 | 8/1995 | Kleinhaeny | 70/406 X |
| 5,475,998 | 12/1995 | Raskevicius et al. | 70/495 |

*Primary Examiner*—Suzanne Dino
*Attorney, Agent, or Firm*—Bacon & Thomas

[57] ABSTRACT

A lock and key combination including a lock cylinder made by connecting a plurality of locking pieces in a stack, each locking piece including a base, which has a top recess at the top side, a front recess, keyway in the middle of the front recess, and a plurality of receiving chambers disposed in the front recess at two opposite sides by the keyway, a plurality of retainer elements mounted in the receiving chambers and forced by a respective spring toward the keyway and having a respective lug at one side, an actuating plate mounted within the front recess of the base, having a projecting locating plate at the top inserted into the top recess of the base and forced upwards by a spring, and a plurality of T-shaped control slots which receive the lugs of the retainer elements, and a cover fastened to the base by hooks and cover over the actuating plate, wherein when the lugs of the retainer elements are moved to the unlocking position by the key, the projecting locating plate is forced into the top recess of the base and released from the casing of the lock which holds the lock cylinder on the inside, permitting the lock cylinder to be unlocked upon a rotary motion of the key.

8 Claims, 4 Drawing Sheets

LOCK AND KEY COMBINATION WITH CHANGEABLE COMBINATION OF LOCKING PIECES

BACKGROUND OF THE INVENTION

1. Field of the Invention

The present invention relates to locking devices, and relates more particularly to a lock and key combination in which the lock cylinder which is comprised of a stack of locking pieces can be conveniently assembled and alternatively arranged into any of a variety of forms.

2. Description of the Prior Art

In the conventional locks, the shapes of their keys are usually varied with the locking structure between the outer cylinder and the inner cylinder of a lock, and the key hole is also varied with the structure of a lock; such conventional locks may be classified as follows:

1. Spiral type: The key hole of the inner cylinder is a spiral-shaped hole. The spiral outer edge of the key is furnished with a plurality of holes for receiving tumblers. Such lock is an ordinary lock, but its manufacturing cost is high; therefore, it is merely used for locking a fixed object or an object having a higher value.

2. Tubular type: The lock has an inner cylinder, in which several locking pieces are mounted, and between two such locking pieces, there is a spring piece being attached. Such inner cylinder is mounted in an outer cylinder. The locking pieces are varied with the grooves designed in the key of the lock. The side edge of the locking piece is furnished with irregular round recesses; the inner cylinder has a long groove for mounting a locking rod. The outer cylinder has a round recess; when the locking rod is set between the long groove of the inner cylinder and the outer cylinder, the lock is in lock-up condition. The lock can be opened by having the locking rod moved to a space between the inner cylinder and the round recesses of the locking pieces.

3. Radial line type: The outer cylinder of such lock is a hollow cylinder, and an inner cylinder with a plurality of radial type tumblers mounted in the outer cylinder; the key of such lock may be a cross-shaped key, a cylindrical-shaped key, a tubular shaped or a flat shaped key.

4. Straight groove type: The inner cylinder of such lock has a key hole under the lower tumblers, which are aligned straight between the outer cylinder and the inner cylinder. Both the tumbler holes of the outer cylinder and the tumbler holes of the inner cylinder are rather long; under the tumbler holes, there is a key hole.

5. Flat type: The inner cylinder of such lock has a key hole being perpendicular to the tumbler holes therein. The flat surface of the key is furnished with a plurality of corresponding tumbler holes so as to facilitate unlocking the lock. So far, it is deemed the best lock that is very difficult to pick. Since the key hole of the lock is perpendicular to the tumbler holes in the inner cylinder, and the flat key is about 3.0 mm thick, a master key, upon being inserted in the lock is unable to drive the lower tumblers to move up and down. The lock can only be unlocked upon the key being inserted and moved in a non-linear direction of the lower tumblers.

6. Other types: Such types include a master lock, a single-tumbler lock, an electronic lock, a push-button lock and a multi-plate lock, which each have its function and picking drawbacks; since they have little relation with the present invention, and therefore no further details are given.

SUMMARY OF THE INVENTION

The prime object of the present invention is to provide a lock and key combination which comprises a plurality of locking pieces connected in a stack to form a lock cylinder, permitting the lock cylinder to be further fastened with a driving element by a clamp and then mounted within a casing to form a lock, therefore the assembly process of the lock is easy.

Another object of the present invention is to provide a lock and key combination in which the locking pieces of the lock cylinder can be conveniently dismounted and then re-arranged into any of a variety of different combinations.

Still another object of the present invention is to provide a lock and key combination in which the locking pieces of the lock cylinder are respectively marked with a respective classification code, and the key is marked with a respective code, and therefore the consumers can freely select the key and arrange the locking pieces into a combination matching with the selected key.

A further object of the present invention is to provide a lock and key combination in which each locking piece comprises a base, a plurality of retainer elements and springs, an actuating plate, and a cover, the base having a keyway in the middle, a plurality of receiving chambers at two opposite sides by the keyway bilaterally extending from the keyway to hold the retainer elements and the springs, the actuating plate being mounted within a front recess of the base and driven to control the movement and positioning of the retainer elements, having a projecting locating plate perpendicularly inserted into the top recess of the base and forced outwards toward the casing of the lock by a spring in the top recess.

A still further object of the present invention is to provide a lock and key combination in which the retainer elements which are respective in the respective receiving chambers of the base each comprises an arched front contact tip perpendicularly inserted into the keyway of the base, a lug at one side spaced from the arched front contact tip at a different distance; the location of the lug on the respective retainer element determines the depth of the key blade slot on the key which drives the respective retainer element; the projecting locating plate of the actuating plate of each locking piece is forced away from the locating groove in the casing into the top recess of the base of the respective locking piece when the lugs of the retainer elements are simultaneously moved to the unlocking position by means of a rotary motion of the key.

A still further object of the present invention is to provide a lock and key combination in which the actuating plate which is mounted within the front recess of the base comprises an elongated slot in the middle aligned with the keyway of the base for the passing of the key blade of the key, and a plurality of T-shaped control slots symmetrically disposed at two opposite sides by the elongated slot corresponding to the tugs of the retainer elements, and the lugs of the retainer elements are respectively inserted into the T-shaped control slots of the actuating plate to limit the displacement of the actuating plate.

A still further object of the present invention is to provide a lock and key combination in which each of the T-shaped control slots of the actuating plate comprises an unlocking control section, a guiding section, and a locating section, the locating section receiving one lug when the lock cylinder is locked, the guiding section being to guide the movement of the respective lug when the respective retainer element is driven by said key, the unlocking control section permitting the actuating plate to be moved when the retainer elements are simultaneously moved to the unlocking position by the key.

Yet another object of the present invention is to provide a lock and key combination in which a plurality of retainer elements and springs are mounted in the receiving chambers of the base of each of the locking pieces, an actuating plate is mounted within the front recess of the base, and a cover is fastened to the base and covered over the actuating plate, the cover having two backward hooks respectively forced into two opposite side notches on the periphery of the base and hooked into two retaining holes at the back side of the base.

BRIEF DESCRIPTION OF THE DRAWINGS

FIG. 10 are schematic drawings, showing different positions of the lugs of the retainer elements in the T-shaped control slots of the actuating plates according to the present invention.

DETAILED DESCRIPTION OF THE PREFERRED EMBODIMENT

Figure 1:
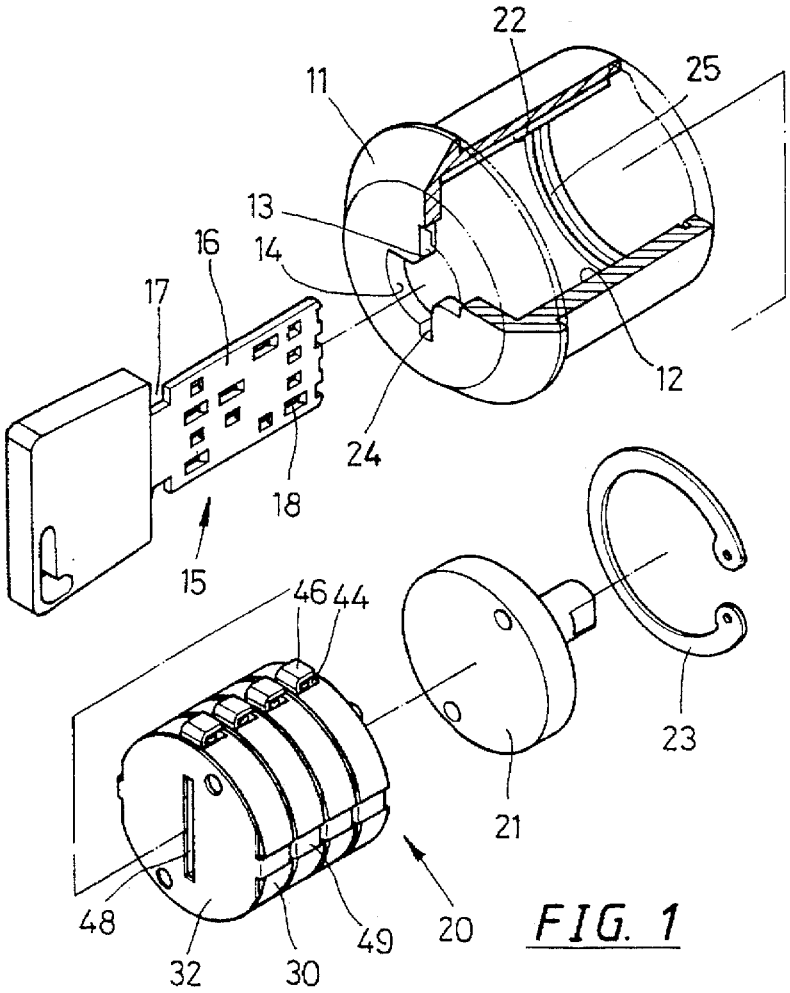
FIG. 1 is an exploded view of the present invention, showing the structure of the lock key combination thereof.
Figure 2:
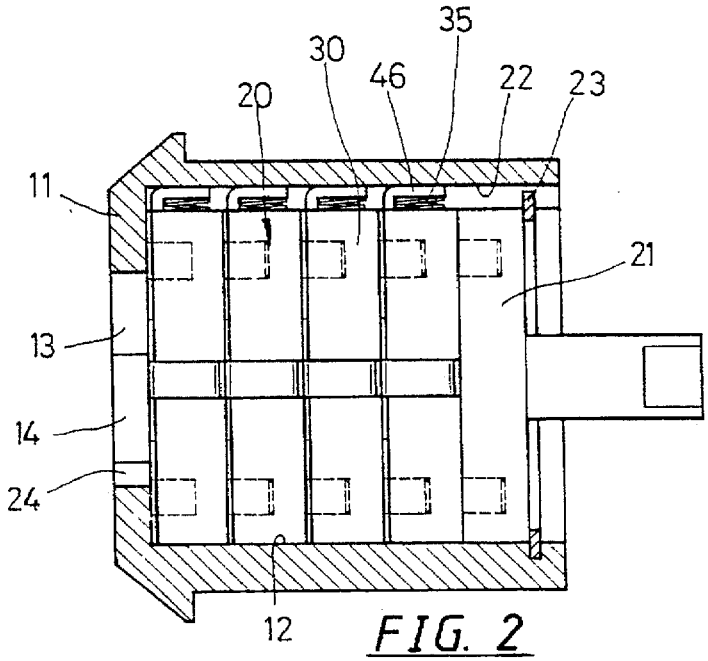
FIG. 2 is a sectional view of the present invention, showing the locking pieces assembled and mounted within the casing.

Referring to FIGS. 1 and 2, a plurality of locking pieces 20 are arranged in a stack to form a lock cylinder with the respective projecting locating plates 46 thereof aligned. The lock cylinder (stack of locking pieces 20) is mounted within the receiving chamber 12 of a cylindrical casing 11, permitting the projecting locating plates 46 of the locking pieces 20 to be respectively inserted into a locating groove 22 inside the casing 11. A driving element 21 is fastened to one end of the lock cylinder (stack of locking pieces 20) and secured in an inside annular groove 25 at the rear end of the casing 11 by a clamp 23. The casing 11 comprises a keyway 13 and a rotary limitation slot 14 at the front end. When the key 15 is inserted into the keyway 13 and rotated, the projecting locating plates 46 are drawn in respective top recesses 44 of the respective locking pieces 20, allowing the locking pieces 20 with the driving element 21 to be turned with the key 15, and therefore the lock is unlocked. Normally, the projecting locating plates 46 of the locking pieces 20 are retained in the locating groove 22 of the casing 11 to hold the lock in the locking position.

Figure 3:
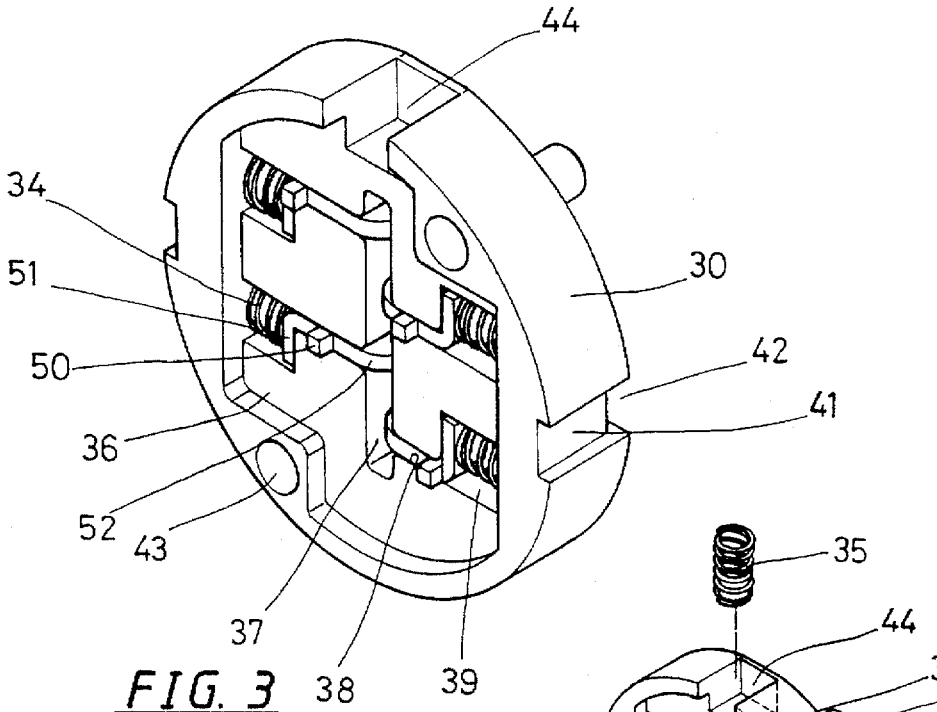
FIG. 3 is an elevational view of the base, showing the retainer elements mounted within the front recess and supported on a respective spring according to the present invention.
Figure 4:
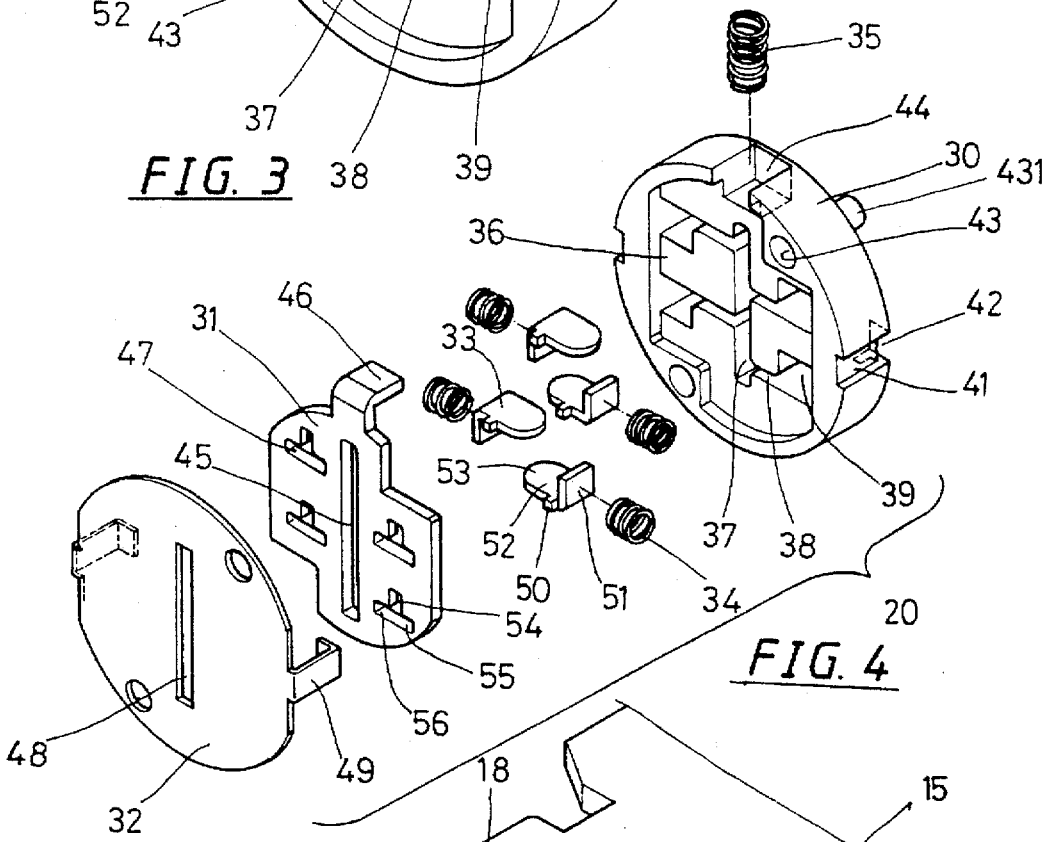
FIG. 4 is an exploded view of one locking piece according to the present invention.

Referring to FIGS. 3 and 4, each of the locking pieces 20 comprises a base 30, an actuating plate 31, a cover 32, a plurality of retainer elements 33, and a plurality of springs 34, 35. The base 30 is shaped like a short cylinder having a front recess 36. The depth of the front recess 36 is slightly deeper than the thickness of the actuating plate 31. A keyway 37 is made in the middle of the front recess 36 of the base 30. A plurality of retainer element receiving chambers 38 and spring receiving chambers 39 are symmetrically formed in the front recess 36 at two opposite sides by the keyway 37 for receiving the retainer elements 33 and the springs 34 respectively. Each of the retainer elements 33 has an arched front contact tip 53 at one end projecting into the keyway 37, a flat tail 51 at an opposite end received in one spring receiving chamber 39 and forced forwards by one spring 34 to keep the arched front contact tip 53 projecting into the keyway 37. A top recess 44 is made on the periphery of the base 30 and disposed in communication with the front recess 36 to hold a spring 35. The actuating plate 31 is mounted within the front recess 36 of the base 30, having a projecting locating plate 46 perpendicularly inserted into the top recess 44 of the base 30 and supported on the spring 35. Two opposite side notches 41 are made on the periphery of the base 30 at two opposite locations. Two opposite retaining holes 42 are made on the back side of the base 30 adjacent to the periphery and respectively connected to the side notches 41. The cover 32 has two backward hooks 49 respectively forced into the side notches 41 and hooked in the retaining holes 42 to hold the actuating plate 31 in the front recess 36 of the base 30. The base 30 further comprises a plurality of pin holes 43 and pins 431 outside the front recess 36 for permitting the locking pieces 20 to be connected in a stack to form a lock cylinder by fitting the pins 431 of one locking piece 20 into the pin holes 43 of another.

Figure 6:
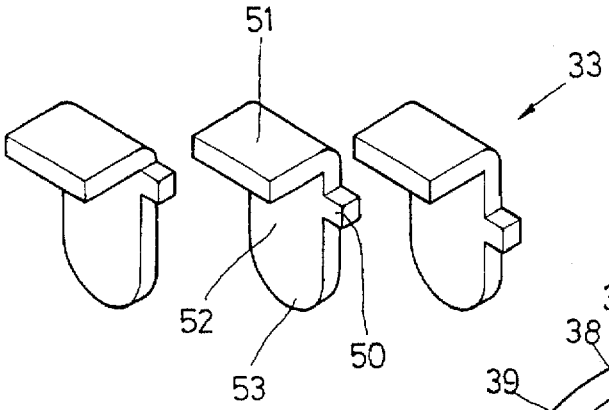
FIG. 6 is an elevational view of the retainer elements according to the present invention, showing the lugs respectively disposed at different locations.

Referring to FIGS. 4 and 6, the retainer elements 33 are respectively made of L-shaped profile from metal by stamping, each having a flat tail 51 received in one retainer element receiving chamber 38 and forced forwards toward the keyway 37 by one spring 34, a flat guide plane 52 perpendicularly extending from one end of the flat tail 51 and disposed in one retainer element receiving chamber 38 to guide the movement of the respective retainer element 33 in a fixed course, and an arched front contact tip 53 smoothly extending forwards from the flat guide plane 52 and partially projecting into the keyway 37. When the key 15 is inserted into the keyway 37 and rotated, the retainer elements 33 are moved upwards or downwards by the blade 16 of the key 15. Each of the retainer elements 33 further comprises a lug 50 at one side inserted into a respective T-shaped control slot 47 on the actuating plate 31. The distance between the lug 50 and the arched front contact tip 53 determines the depth of the respective key blade slot 18.

The aforesaid retainer elements 33 are respectively mounted in the retainer element receiving chambers 38 of the base 30 with the respective arched front contact tips 53 projecting into the keyway 37. When the key 15 is inserted into the keyway 37, the arched front contact tips 53 of the retainer elements 33 are disposed in contact with the key 15 and forced by it to move the respective retainer elements 33. The respective moving distances of the retainer elements 33 determine if the lugs 50 of the retainer elements 33 are simultaneously moved to the mouths of the respective unlocking control sections 54 (this will be described further), so as to further determine if the locking pieces 20 can be unlocked or not.

Referring to FIGS. from 7 to 10, the actuating plate 31 is mounted within the front recess 36 of the base 30, having a projecting locating plate 46 disposed at the top at right angles which is inserted into the top recess 44 of the base 30 and forced outwards by the spring 35 in the top recess 44. When the projecting locating plate 46 is supported on the spring 35 in the top recess 44 of the base 30, a space 40 is defined between the bottom edge of the front recess 36 and the actuating plate 31 for the movement of the actuating plate 31 so that the projecting locating plate 46 can be forced into the inside of the top recess 44 of the base 30. The actuating plate 31 has an elongated slot 45 in the middle aligned with the keyway 37 of the base 30 for the passing of the key 15. The elongated slot 45 is so long that the actuating plate 31 can be moved up and down in the front recess 36 of the base 30. A plurality of T-shaped control slots 47 are made on the actuating plate 31 at two opposite sides by the elongated slot 45 for receiving the lugs 50 of the retainer elements 33. Each of the T-shaped control slots 47 comprises an unlocking control section 54, a guiding section 55, and a locating section 56. Normally, the lug 50 is received in the locating section 56. The guiding section 55 is to guide the movement of the lug 50 when the respective retainer element 33 is driven by the key blade 16. The unlocking control section 54 imparts a space for the movement of the actuating plate 31 when the retainer elements 33 are simultaneously moved by the key 15 to the unlocking position.

Referring to FIG. 4, the cover 32 is made from a thin metal plate by stamping and closely attached to the base 30 at the front side, having an elongated slot 48 in the middle aligned with the keyway 37 of the base 30 for the passing of the key blade 16 of the key 15, two backward hooks 49 at two opposite sides respectively forced into the side notches 41 of the base 30 and hooked in the retaining holes 42. When each locking piece 20 is assembled, the locking pieces 20 are connected together by means of the pins or pin holes 43 to form a lock cylinder.

Referring to FIGS. from 1 to 4, the lock cylinder is mounted within the receiving chamber 12 of the casing 11, and the driving element 21 is fastened to the rear end of the lock cylinder. When the key 15 is inserted into the lock cylinder to turn the retainer elements 33 of the locking pieces 20 to the unlocking position, the locating plates 46 of the locking pieces 20 are forced by the reduced surface of the locating groove 22 into the inside of the top recesses 44 of the respective locking pieces 20, permitting the driving element 21 to be turned with the locking pieces 20 by the key 15.

Figure 5:
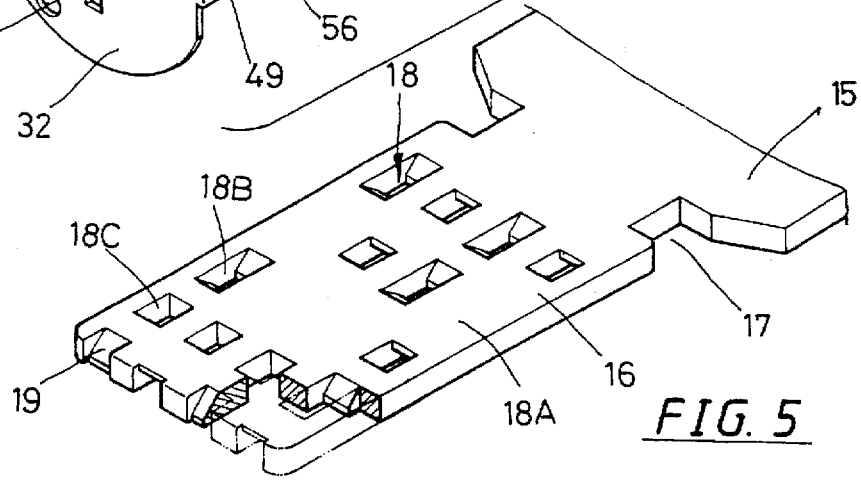
FIG. 5 is a cutaway of the key, showing the structure of the key blade slot according to the present invention.

Referring to FIGS. 1 and 5, the key blade 16 of the key 15 has a plurality of key blade slots 18 arranged in proper order. The key blade 16 has a plurality of sloping surfaces 19 at the front end for moving the retainer elements 33 in each locking piece 20 upon the insertion of the key blade 16 into the keyway 37 of each locking piece 20. The key blade slots 18 of the key blade 16 determine the moving distance of the retainer elements 33. The depth of each of the key blade slots 18 is defined by a flat blade face portion 18A, two symmetrical sloping surface portions 18B, and a vertical slot section 18C. The height of the symmetrical sloping surface portions 18B determines the relative arrangement between the locking pieces 20 and the key blade slots 18. Two opposite side notches 17 are made on the key blade 16 near one end remote from the sloping surfaces 19 and respectively disposed in line with the key blade slots 18. Without the arrangement of the side notches 17, the key 15 cannot be rotated after its insertion into the keyway 37 of each locking piece 20. The lock cylinder which is mounted within the casing 11 and driven to turn the driving element 21 by means of the rotary motion of the key 15. A trapezoidal notch 24 is formed on the casing 11 between the keyway 13 and rotary limitation slot 14 to prevent the locking pieces 20 from being turned by a pry or the like. When a pry or the like is inserted into the keyway 13 of the casing 11, it cannot obtain the point of force for rotary motion because of the presence of the trapezoidal notch 24, and therefore a burglar cannot use a pry or the like to unlock the locking pieces 20.

Referring to FIG. 10, the depth of each of the key blade slots 18 is defined by a flat blade face portion 18A, two symmetrical sloping surface portions 18B, and a vertical slot section 18C. FIG. 10A shows the lugs 50 of the retainer elements 33 disposed in the locating sections 56 of the respective T-shaped control slots 47. The relative position of the lug 50 in the respective locating section 56 controls the depth of the respective key blade slot 18. Referring to FIG. 10B, before the insertion of the key, the lug 50 is disposed at the bottom edge of the respective locating section 56. FIG. 10C shows the lug 50 moved to the mouth of the respective unlocking control section 54 by the flat blade face portion 18A. If the key blade slot 18 is not manipulated, the respective lug 50 will not be moved to the mouth of the respective unlocking control section 54. FIG. 10D shows the lug 50 of the respective retainer element 33 partially moved to the mouth of the respective unlocking control section 54, and the actuating plate 31 is still stopped from movement. The lug 50 of the respective retainer element 33 must be manipulated by the vertical slot section 18C of the respective key blade slot 18. When the key blade 16 is inserted into position and rotated, the lug 50 of each retainer element 33 will be moved by the respective vertical slot section 18C to the mouth of the respective unlocking control section 54 (see FIG. 10E). If the key blade is made of thickness equal to the flat blade face portion 18A, the lug 50 will be moved to the respective locating section 55, and the actuating plate 31 will still be stopped from movement. If the key blade is made of thickness equal to the symmetrical sloping surface portions 18B, the lug 50 will be maintained immovable upon the insertion of the key blade. FIG. 10F shows the lug 50 of the respective retainer element 33 disposed in the mouth of the respective unlocking control section 54, however the lug 50 will be further moved into the locating section 56 to constrain the displacement of the actuating plate 31 if not manipulated by the symmetrical sloping surface portions 18B. When manipulated by the symmetrical sloping surface portions 18B, the lug 50 is maintained in the mouth of the respective unlocking control section 54 (see FIG. 10G).

Figure 7:
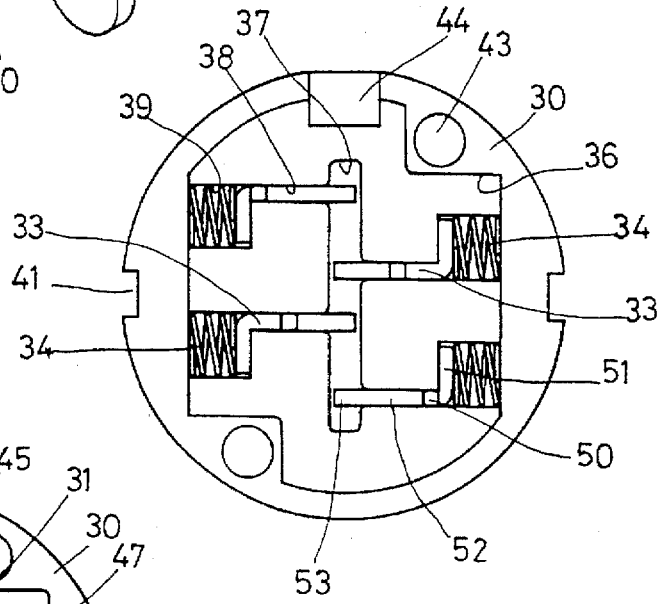
FIG. 7 is a plain view of the locking piece according to the present invention, showing the retainer elements and the springs mounted inside the front recess of the base.
Figure 8:
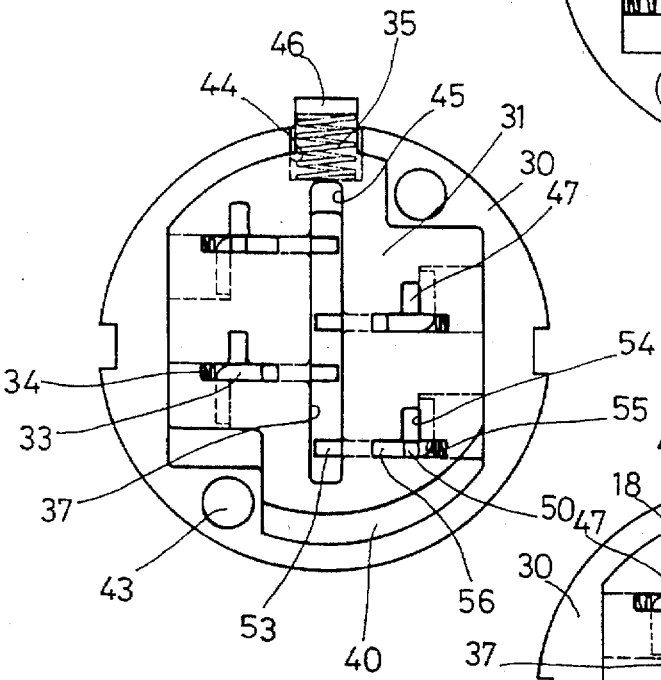
FIG. 8 is a plain view of the locking piece according to the present invention, showing the position of the actuating plate relative to the retainer elements.
Figure 9:
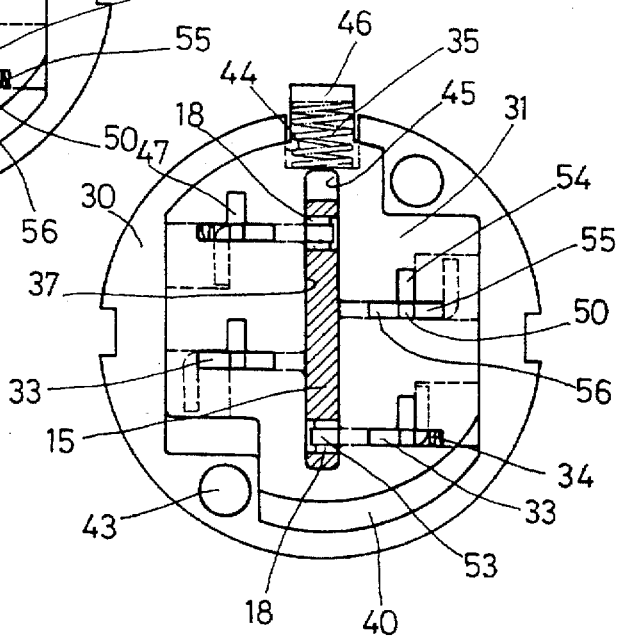
FIG. 9 is a plain view of the locking piece according to the present invention, showing the locking piece unlocked.
Figure 6:
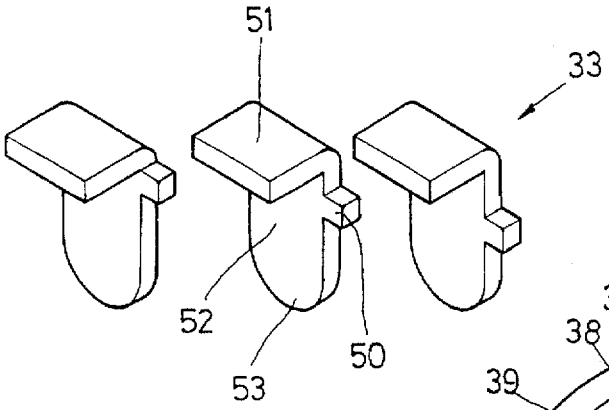
Figure 7:
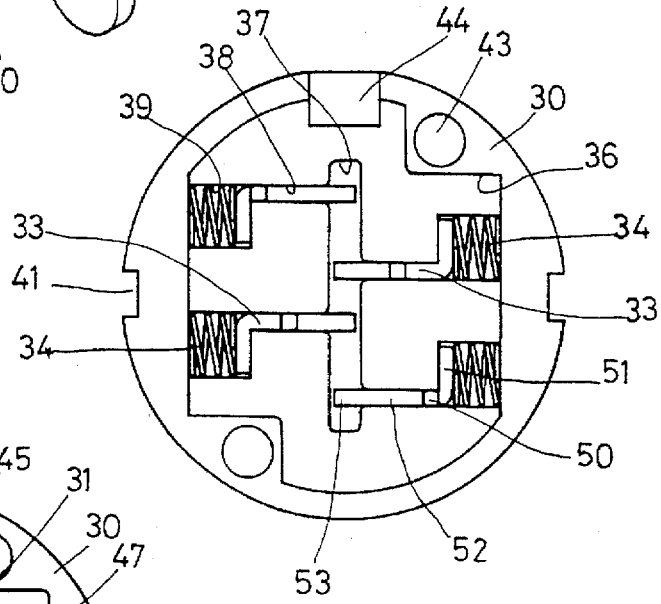
Figure 8:
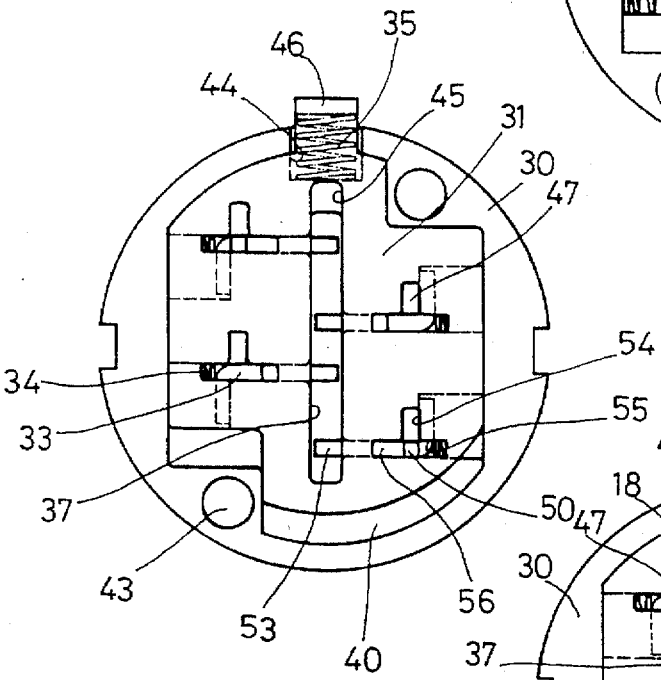
Figure 9:
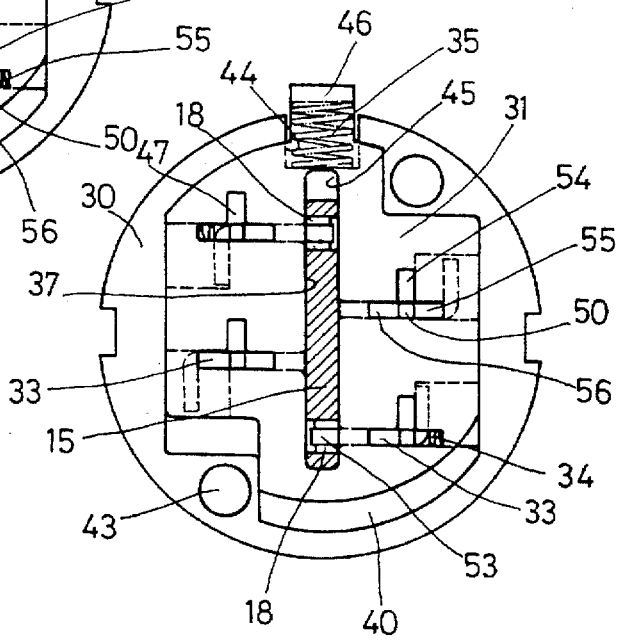

Referring to FIGS. 7 to 10, the height of the lug 50 of each retainer element 33 controls the depth of the respective key blade slot 18 of the key 15. The actuating plates 31 of the locking pieces 20 are respectively moved to the unlocking position only when the lugs 50 of the retainer elements 33 are moved by the respective key blade slots 18 of the key 15 to the respective unlocking control sections 54. If any key blade slot 18 cannot move the respective lug 50 to the respective unlocking control section 54, the respective actuating plate 31 will be stopped from displacement, and the projecting locating plate 46 of the respective actuating plate 31 will not be forced into the inside of the respective top recess 44, and therefore the respective locking piece 20 will not be moved to the unlocking position. As shown in FIG. 7, before the insertion of the key blade 16 into the keyway 37 of each locking piece 20, the retainer elements 33 are forced by the respective springs 34 toward the keyway 37, and the lugs 50 are respectively disposed in different positions. As shown in FIG. 8, when the actuating plate 31 is mounted in the front recess 36 of the base 30 of the respective locking piece 20, the projecting locating plate 46 is forced out of the top recess 44 by the spring 35 in the top recess 44, and the lugs 50 of the retainer elements 33 are respectively disposed in the respective locating sections 56. If the lug 50 of any retainer element 33 is disposed in the respective locating section 56 or not moved to the mouth of the respective unlocking control section 54, the respective actuating plate 31 is stopped from displacement, and the lock is stopped from being unlocked. Referring to FIG. 9, when the key 15 is inserted into the keyway 37 of the base 30 of each locking piece 20 and turned to move the retainer elements 33, the lugs 50 of the retainer elements 33 will be moved along the respective guiding sections 55 until the key 15 is set into position. If the key blade slots 18 match with the heights of the lugs 50 of the retainer elements 33 respectively, the lugs 50 of the retainer elements 33 will be simultaneously moved to the mouths of the respective unlocking control sections 54, permitting the projecting locating plates 46 of the actuating plates 31 to be turned away from the locating groove 22 and forced into the inside of the respective top recesses 44 of the bases 30 of the respective locking pieces 20.

As indicated, the lock cylinder is comprised of a plurality of locking pieces 20 connected into a stack and mounted within the casing 11; the retainer elements of each locking piece 20 are disposed perpendicular to the keyway 37 of the respective base 30; the lugs 50 of the retainer elements 33 must be moved to the same elevation by the different depths of key blade slots 18 of the key blade 16 so that the lock can be unlocked, therefore the burglar cannot open the lock easily by a pry or the like; the locking pieces 20 are respectively assembled and marked with a respective classification code, so that the lock cylinder can be assembled subject to the code of the key 15, and then mounted in the receiving chamber 12 of the casing 11. By changing the combination of the locking pieces 20, different locks can be obtained to match with different keys.

According to the aforesaid description of the embodiment, the features and structure of the present invention have been disclosed completely; it is apparent that considerable improvement has been made in the present invention, and it is never anticipated by any one who is skilled in such art; therefore, the present invention is deemed unique in terms of structure.

We claim:

1. A lock and key combination comprised of a casing, a lock cylinder mounted within said casing, and a key for turning said lock cylinder between a locking position and an unlocking position, said lock cylinder comprised of a plurality of locking pieces connected in a stack and retained in a line in a locating groove inside said casing and fastened with a driving element by a clamp, said key comprising a key blade having a plurality of key blade slots, wherein each locking piece comprises:

a base having a short cylindrical configuration having a front recess, a keyway in a middle of said front recess, a plurality of retainer element receiving chambers and spring receiving chambers perpendicularly connected to the keyway of said base at two opposite sides within said front recess, a top recess on a periphery in communication with said front recess, two opposite side notches on a periphery at two opposite sides, and two opposite retaining holes at a back side thereof respectively connected to said side notches;

a first spring element mounted within the top recess of said base;

an actuating plate mounted within the front recess of said base, having a projecting locating plate at a top side thereof perpendicularly inserted into the top recess of said base and forced outwards by said first spring element, an elongated slot in a middle in alignment with the keyway of said base for the passing of said key, and a plurality of inverted T-shaped control slots disposed at two opposite sides adjacent the elongated slot of said actuating plate, a thickness of said actuating plate being thinner than a depth of the front recess of said base;

a plurality of retainer elements respectively mounted in said retainer element receiving chambers and said spring receiving chambers, each retainer element comprising a flat tail received in one retainer element receiving chamber, a flat guide plane perpendicularly extending from one end of said flat tail to guide the movement of the respective retainer element in a fixed course, an arched front contact tip extending forwards from said flat guide plane and partially projecting into the keyway of said base, and a lug at one side of said flat guide plane inserted into one control slot of said actuating plate;

a plurality of second spring elements respectively mounted within said spring receiving chambers and stopped against the flat tails of said retainer elements to force said retainer elements toward the keyway of said base; and a cover covered on said base to hold said actuating plate inside the front recess of said base, said cover comprising an elongated slot in a middle in alignment with the elongated slot of said actuating plate and the keyway of said base for the insertion of said key, two backward hooks respectively forced into the side notches of said base and hooked in the retaining holes of said base.

2. A lock and key combination as the claimed in claim 1, wherein the top recess of said base is disposed in communication with the front recess thereof and the projecting locating plate of said actuating plate is supported on said first spring element above the top recess of said base so that when said actuating plate is unlocked by said key, the projecting locating plate of said actuating plate is forced into the top recess of said base to compress said first spring element.

3. A lock and key combination as the claimed in claim 1, wherein the elongated slot of said actuating plate is so long that said actuating plate can be driven to move within the front recess of said base, and a space is defined between said actuating plate and a bottom edge of said front recess, so that the projecting locating plate of said actuating plate can be forced into an inside of the top recess of said base.

4. A lock and key combination as the claimed in claim 1, wherein each of said T-shaped control slots comprises an unlocking control section, a guiding section, and a locating section, said locating section receiving one lug when the lock cylinder is locked, said guiding section being to guide the movement of the respective lug when the respective retainer element is driven by said key, said unlocking control section permitting said actuating plate to be moved when said retainer elements are simultaneously moved to the unlocking position by said key.

5. A lock and key combination as the claimed in claim 1, wherein the lugs of said retainer elements are respectively inserted into the T-shaped control slots of said actuating plate, and a distance between the lug and the arched front contact tip of each retainer element determines the depth of the respective key blade slot of the key blade of said key.

6. A lock and key combination as the claimed in claim 1, wherein a depth of each key blade slot is defined by a flat blade face portion, two symmetrical sloping surface portions, and a vertical slot section, and a height of said symmetrical sloping surface portions determines a relative arrangement between said locking pieces and said key blade slots.

7. A lock and key combination as the claimed in claim 1, wherein the base of each locking piece comprises a plurality of pins and pin holes so that said locking pieces can be connected in a stack by fitting the pins of the base of one locking piece into the pin holes of the base of another.

8. A lock and key combination as the claimed in claim 5, wherein a depth of each key blade slot is defined by a flat blade face portion, two symmetrical sloping surface portions, and a vertical slot section, and a height of said symmetrical sloping surface portions determines a relative arrangement between said locking pieces and said key blade slots.

* * * * *